US005368777A

United States Patent [19]

Forester

[11] Patent Number: 5,368,777

[45] Date of Patent: Nov. 29, 1994

[54] USE OF DISPERSANT ADDITIVES AS PROCESS ANTIFOULANTS

[75] Inventor: David R. Forester, Conroe, Tex.

[73] Assignee: Betz Laboratories, Inc., Trevose, Pa.

[21] Appl. No.: 423

[22] Filed: Jan. 4, 1993

[51] Int. Cl.[5] ..... C10G 9/16

[52] U.S. Cl. ..... 252/403; 208/48 AA

[58] Field of Search ..... 252/403; 208/48 AA

[56] References Cited

U.S. PATENT DOCUMENTS 3,235,484 2/1966 Colfer ..... 208/48

4,578,178 3/1986 Forester ..... 208/48 AA 4,584,117 4/1986 Wollenberg ..... 252/51.5 A 4,883,886 11/1989 Huang ..... 549/255

*Primary Examiner*—Robert L. Stoll

*Assistant Examiner*—Valerie Fee

*Attorney, Agent, or Firm*—Alexander D. Ricci; Richard A. Paikoff

[57] ABSTRACT

Reaction products of polyalkenylsuccinic anhydrides with a prereacted product of polyamine and a cyclic carbonate are used as effective antifoulants in liquid hydrocarbonaceous mediums, such as crude oils, during processing of such liquids at elevated temperatures.

8 Claims, No Drawings

USE OF DISPERSANT ADDITIVES AS PROCESS ANTIFOULANTS

FIELD OF THE INVENTION

The present invention pertains to the use of the reaction products of polyalkenylsuccinic anhydrides with a polyamine and a cyclic carbonate to inhibit fouling in liquid hydrocarbon mediums during the heat treatment processing of the medium, such as in refinery processes.

BACKGROUND OF THE INVENTION

In the processing of petroleum hydrocarbons and feed stocks, such as petroleum processing intermediates, and petrochemicals and petrochemical intermediates, e.g., gas, oils and reformer stocks, chlorinated hydrocarbons and olefin plant fluids, such as deethanizer bottoms, the hydrocarbons are commonly heated to temperatures of 40° to 550° C., frequently from 200–550° C. Similarly, such petroleum hydrocarbons are frequently employed as heating mediums on the "hot side" of heating and heating exchange systems. In virtually every case, these petroleum hydrocarbons contain deposit-forming compounds or constituents that are present before the processing is carried out. Examples of these preexisting deposit forming materials are alkali and alkaline earth metal-containing compounds, such as sodium chloride; transition metal compounds or complexes, such as porphyrins or iron sulfide: sulfur-containing compounds, such as mercaptans; nitrogen-containing compounds, such as pyrroles; carbonyl or carboxylic acid-containing compounds; poly-nuclear aromatics, such as asphaltenes: and/or coke particles. These deposit-forming compounds can combine or react during elevated temperature processing to produce a separate phase known as fouling deposits, within the petroleum hydrocarbon. In all cases, these deposits are undesirable by-products. In many processes, the deposits reduce the bore of conduits and vessels to impede process throughput, impair thermal transfer, and clog filter screens, valves and traps. In the case of heat exchange systems, the deposits form an insulating layer upon the available surfaces to restrict heat transfer and necessitate frequent shut-downs for cleaning. Moreover, these deposits reduce throughput, which of course results in a loss of capacity with a drastic effect in the yield of finished product. Accordingly, these deposits have caused considerable concern to the industry.

While the nature of the foregoing deposits defies precise analysis, they appear to contain either a combination of carbonaceous phases which are coke-like in nature, polymers or condensates formed from the petroleum hydrocarbons or impurities present therein and/or salt formations which are primarily composed of magnesium, calcium and sodium chloride salts. The catalysis of such condensates has been attributed to metal compounds such as copper or iron which are present as impurities. For example, such metals may accelerate the hydrocarbon oxidation rate by promoting degenerative chain branching, and the resultant free radicals may initiate oxidation and polymerization reactions which form gums and sediments. It further appears that the relatively inert carbonaceous deposits are entrained by the more adherent condensates or polymers to thereby contribute to the insulating or thermal opacifying effect.

Fouling deposits are equally encountered in the petrochemical field wherein the petrochemical is either being produced or purified. The deposits in this environment are primarily polymeric in nature and do drastically affect the economies of the petrochemical process. The petrochemical processes include processes ranging from those where ethylene or propylene, for example, are obtained to those wherein chlorinated hydrocarbons are purified.

Other somewhat related processes where antifoulants may be used to inhibit deposit formation are the manufacture of various types of steel or carbon black.

SUMMARY OF THE INVENTION

In accordance with the invention, the reaction products of polyalkenylsuccinic anhydrides with a prereacted product of a polyamine with a cyclic carbonate are used to inhibit fouling of heated liquid hydrocarbon mediums. Typically, such antifoulant protection is provided during heat processing of the medium, such as in refinery, purification, or production processes.

The reaction products of the type used herein have been disclosed in U.S. Pat. No. 4,584,117 as dispersant additives for use in lubricating oils.

DETAILED DESCRIPTION OF THE INVENTION

I have found that the reaction products of polyalkenylsuccinic anhydrides with a polyamine and a cyclic carbonate (preferably, a prereacted product of polyamine and cyclic carbonate) provide significant antifoulant efficacy in liquid hydrocarbonaceous mediums during the high temperature treatments of the medium.

It is to be understood that the phrase "liquid hydrocarbonaceous medium" as used herein signifies various and sundry petroleum hydrocarbons and petrochemicals that are undergoing some type of heat treatment processing. For instance, petroleum hydrocarbons such as petroleum hydrocarbon feedstocks including crude oils and fractions thereof such as naphtha, gasoline, kerosene, diesel, jet fuel, gas oil, vacuum residua, etc., are all included in the definition.

Similarly, petrochemicals such as olefinic or naphthenic process streams, aromatic hydrocarbons and their derivatives, ethylene dichloride, and ethylene glycol are all considered to be within the ambit of the phrase "liquid hydrocarbonaceous mediums".

The reaction products useful in the invention may be prepared by reacting a polyalkenylsuccinic anhydride with a prereacted product of a polyamine and a cyclic carbonate.

More specifically, the starting reactant, polyalkenyl succinic anhydride may be purchased commercially or prepared. Presently, it is preferred to buy this from Texaco. One such commercially sold polyalkenylsuccinic anhydride is sold under the trademark LA-627. It is a polyisobutenylsuccinic anhydride (PIBSA) having the structure

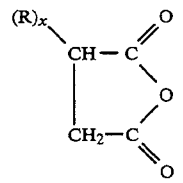

(I)

wherein, in this case, R is an isobutenyl repeat unit. The average molecular weight of the polyisobutene used to produce the PIBSA is about 1300.

The precursor polyalkenylsuccinic anhydride may also be prepared as reported in U.S. Patent 3,235,484 (Colfer), incorporated herein by reference or by the methods reported in U.S. Pat. No. 4,883,886 (Huang), also incorporated by reference herein. As to the Col fer method, the anhydrides may be prepared by reaction of maleic anhydride with a high molecular weight olefin or a chlorinated high molecular weight olefin. In the Huang method, reaction of a polymer of a $C_2$–$C_8$ olefin and maleic anhydride are carried out in the presence of a tar and side product suppressing agent.

The most commonly used sources for forming the aliphatic R substituent on the succinic anhydride compound (I) are the polyolefins, such as polyethylene, polypropylene, polyisobutene, polyamylene, polyisohexylene, etc. The most particularly preferred polyolefin (and the one used to manufacture the polyisobutenylsuccinic anhydride from Texaco) is polyisobutene. As Colfer states, particular preference is made for such a polyiso-butene-containing at least about 50 carbon atoms, preferably from at least 60 carbon atoms and most desirably from about 100 to about 150 carbon atoms. Accordingly, an operable carbon atom number range for R is from about 30–200 carbon atoms.

Once the polyalkenylsuccinic anhydride precursor is obtained, it is reacted with a prereacted product of a polyamine with a cyclic carbonate. More specifically, the polyalkenylsuccinic anhydride

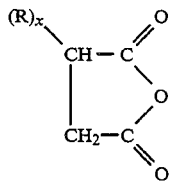

(I)

wherein R is an aliphatic alkenyl or alkyl moiety having at least about 50 carbon atoms and less than about 200 carbon atoms, is reacted with a corresponding carbamate or hydroxyalkylamine derivative obtained from the reaction product of a cyclic carbonate with a primary or secondary amine.

The additives are prepared-by first reacting a polyamine with a cyclic carbonate. The reaction is conducted at a temperature sufficient to cause reaction of the cyclic carbonate with the polyamine. In particular, reaction temperatures of from about 0° C. to about 250° C. are preferred with temperatures of from about 100° C. to 200° C. being most preferred.

The reaction may be conducted neat—that is, both the polyamine and the cyclic carbonate are combined in the proper ratio, either alone or in the presence of a catalyst, and then stirred at the reaction temperature. Examples of suitable catalysts include, for instance, boron trifluoride, alkane sulfonic acid, alkali or alkaline carbonate. The reaction is generally complete in about 0.5 to 10 hours.

The polyamine-cyclic carbonate adduct is then contacted with an alkenyl or alkyl succinic anhydride. The reaction is conducted at a temperature sufficient to cause reaction of the adduct with the alkenyl or alkyl succinic anhydride. Reaction temperatures of from about 0° C. to about 250° C. are preferred with temperatures of from about 100° C. to 200° C. being most preferred.

The reaction may be conducted neat—that is, the alkenyl or alkyl succinic anhydride may be combined with the polyamine-cyclic carbonate adduct in the proper ratio, and then stirred at the reaction temperature.

Mole ratios of the cyclic carbonate to the basic amine nitrogen of the polyamine employed are generally in the range of from about 0.1:1 to 10:1, preferably from about 0.5:1 to 5:1.

Mole ratios of the alkenyl or alkyl succinic anhydride to the cyclic carbonate-polyamine adduct are generally in the range of from about 0.5:1 to 5:1, preferably from about 0.5:1 to 2:1, most preferably from about 1:1 to 2:1.

Typical polyamines that can be used include the following: ethylene diamine, 1,2-propylene diamine, 1,3-propylene diamine. diethylene triamine, triethylene tetramine, hexamethylene diamine and tetraethylene pentamine. The following are examples of suitable cyclic carbonates: 1,3-dioxolan-2-one (ethylene carbonate); 4-methyl-1,3-dioxolan-2-one (propylene carbonate)-4-hydroxy-methyl-1,3-dioxolan-2-one; 4,5-dimethyl-1,3-dioxolan-2-one: 4-ethyl-1,3-dioxolan-2-one; and 4,4,-dimethyl-1,3-dioxolan-2-one.

At present, preliminary studies have indicated surprisingly effective antifouling inhibition results with these reaction products.

The reaction products useful in the invention may be added to or dispersed within the liquid hydrocarbonaceous medium in need of antifouling protection in an amount of 0.5–10.000 ppm based upon one million parts of the liquid hydrocarbonaceous medium. Preferably, the antifoulant is added in an amount of from 1 to 2500 ppm.

The reaction products may be dissolved in a polar or non-polar organic solvent, such as heavy aromatic naphtha, toluene, xylene, or mineral oil and fed to the requisite hot process fluid or they can be fed neat thereto. These products are especially effective when added to the liquid hydrocarbonaceous medium during the heat processing thereof at temperatures from 200–550° C.

EXAMPLE

To a 150 ml resin kettle equipped with a mechanical stirrer, a thermometer, a condenser, a Dean-Stark trap and a nitrogen inlet were charged ethylene carbonate (17.4g, 198 mmole), mineral oil (45.3g) and tetraethylenepentamine (12.5g, 66 mmole). The mixture was heated to 200° C. for one hour. The product of the reaction separated from the oil. The contents of the kettle were transferred to a separatory funnel, and the bottom layer was isolated. It was charged to a flask fitted with a short-path distillation head, and the material was heated to 200° C. under vacuum (71 mm Hg) until no more distillate was removed. The residue (19.94 g) was combined with mineral oil (45.3g) and 65% polyisobutenylsuccinic anhydride (92.3g, mw 1300, 46 mmole) and heated to 170° C. for 2.0 hours. A Dean-Stark trap was added to the condenser and heating at 170° C. was continued under vacuum (71 mm Hg) until no more water was collected. This resulted in a viscous brown oil.

ANTIFOULANT TESTS

The dual fouling apparatus (DFA), as described in U.S. Pat. No. 4,578,178, was used to determine the antifoulant efficacy in crude oil of the product of (1) tetraethylenepentamine reacted with (2) ethylenecarbonate, {he product being subsequently reacted with polyisobutenylsuccinic anhydride, as illustrated in Table 1. The antifoulant efficacy of a polyisobutenyl succinimide antifoulant, sold commercially as a dispersant additive for automotive lubricating oils, was compared to this compound in crude oil with results detailed in Table 1.

The DFA used to generate the data shown in Table I contains two independent, heated rod exchangers. In the DFA tests, rod temperature was controlled while testing. As fouling on the rod occurs, less heat is transferred to the fluid so that the process fluid outlet temperature decreases. Antifoulant protection was determined by comparing the summed areas between the heat transfer curves for control and treated runs and the ideal case for each run. In this method, the temperatures of the oil inlet and outlet and rod temperatures at the oil inlet (cold end) and outlet (hot end) are used to calculate U-rig coefficients of heat transfer every 2 minutes during the tests, From these U-rig coefficients, areas under the fouling curves are calculated and subtracted from the non-fouling curve for each run. Comparing the areas of control runs (averaged) and treated runs in the following equation results in a percent protection value for antifoulants.

$$\% \text{ Protection} = \frac{\text{Avg. } \Delta \text{ Area (control)} - \Delta \text{ Area (Treatment)}}{\text{Avg. } \Delta \text{ Area (control)}} \times 100$$

TABLE 1

Summary of DFA Results on Example 1 Compared to Polyisobutenyl Antifoulant (PIBSA Succinimide) Desalted Crude Oil, 482° C. Rod Temperature

| Additive (ppm active) | % Protection |
|---|---|
| PIBSA Succinimide | |
| (62.5) | 8 (Avg.) |
| (125) | 9 |
| (250) | 18 |
| Example 1 | |
| (62.5) | 15 |
| (125) | 1 |
| (250) | 32 |

As shown in Table 1, the ant i foul ant efficacy of the reaction product of example 1 was higher than that of PIBSA succinimide when tested at dosages of 62.5 and 250 ppm active.

While this invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

I claim:

1. A method of inhibiting fouling deposit formation in crude oil during heat treatment in a refining process at temperatures from about 200–550° C., wherein, in the absence of such antifouling treatment, fouling deposits are normally formed as a separate phase within said crude oil impeding process throughput and thermal transfer, said method comprising adding to said crude oil, an antifouling amount of a reaction product of a hydrocarbylsuccinic anhydride having the formula

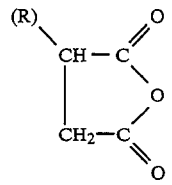

wherein R is an aliphatic alkenyl or alkyl moiety having at least about 50 carbon atoms and less than about 200 carbon atoms, with the reaction product of a polyamine and a cyclic carbonate.

2. The method as recited in claim 1 wherein said reaction product is added to said crude oil during heating of said crude oil at a temperature of from about 300–550° C.

3. The method as recited in claim 1 further comprising adding from about 0.5–10,000 parts by weight of said reaction product to said crude oil based upon one million parts of said crude oil.

4. The method as recited in claim 1 wherein R comprises more than 50 carbon atoms and is a polyalkenyl moiety.

5. The method as recited in claim 1 wherein said polyamine comprises tetraethylenepentamine.

6. The method as recited in claim 1 wherein said cyclic carbonate comprises ethylenecarbonate.

7. The method as recited in claim 4 wherein R comprises a repeated isobutenyl moiety.

8. The method as recited in claim 7 wherein R has a molecular weight of about 1300.

* * * * *